US007918053B2

(12) United States Patent
Bucher et al.

(10) Patent No.: US 7,918,053 B2
(45) Date of Patent: Apr. 5, 2011

(54) CONTAINER

(75) Inventors: Hubert Bucher, Deggenhauser Tal (DE); Andreas Serden, Meersburg (DE); Patrick Treutle, Immenstaad (DE)

(73) Assignee: EADS Deutschland GmbH, Ottobrunn (DE)

( * ) Notice: Subject to any disclaimer, the term of this patent is extended or adjusted under 35 U.S.C. 154(b) by 1332 days.

(21) Appl. No.: 10/765,951

(22) Filed: Jan. 29, 2004

(65) Prior Publication Data

US 2005/0122014 A1 Jun. 9, 2005

(30) Foreign Application Priority Data

Dec. 3, 2003 (DE) ..... 103 56 455

(51) Int. Cl.
*E04B 1/346* (2006.01)

(52) U.S. Cl. ..... 52/67; 52/69

(58) Field of Classification Search ..... 52/79.5, 52/79.6, 79.7, 67, 68, 66, 69, 64; 296/165, 296/175, 173, 171, 162; 220/8, 720
See application file for complete search history.

(56) References Cited

U.S. PATENT DOCUMENTS

| | | | | |
|---|---|---|---|---|
| 2,167,557 | A * | 7/1939 | Stout | 52/69 |
| 4,689,924 | A * | 9/1987 | Jurgensen | 52/67 |
| 5,732,839 | A * | 3/1998 | Schimmang et al. | 220/1.5 |
| 5,921,033 | A * | 7/1999 | Molina | 52/67 |
| 6,003,919 | A * | 12/1999 | Shook | 296/26.14 |
| 7,000,795 | B2 * | 2/2006 | Serden | 220/1.5 |
| 7,073,844 | B2 * | 7/2006 | Garceau et al. | 296/165 |
| 2002/0179598 | A1 * | 12/2002 | Kuhn | 220/1.5 |
| 2003/0213185 | A1 | 11/2003 | Findley | |

FOREIGN PATENT DOCUMENTS

| | | |
|---|---|---|
| DE | 9216314 | 3/1993 |
| DE | 9421477 U1 | 1/1996 |
| DE | 10135226 | 2/2003 |
| EP | 0682156 | 11/1995 |
| FR | 983214 | 6/1951 |
| WO | WO 98/51875 | 11/1998 |

* cited by examiner

*Primary Examiner* — Lanna Mai
*Assistant Examiner* — Adrianna Figueroa
(74) *Attorney, Agent, or Firm* — Crowell & Moring LLP

(57) ABSTRACT

A basic container has at least one expansion element which can be moved out of the basic container. A lifting device permits lowering of the expansion element such that, after the expansion element has been moved out of the basic container, the floor wall of the expansion element and the basic container are situated at the same level. An expansion element can be lifted such that, after the lowering, the expansion element can be moved back into the basic container. The lifting device is active between the folded-open side wall and the expansion element.

17 Claims, 11 Drawing Sheets

CONTAINER

BACKGROUND OF THE INVENTION

The present invention relates to an expandable container, for example, according to the ISO Standard, particularly as a working space. Man-sized accessible containers of this type are also called "shelters" in English-speaking areas.

An expandable container is described, for example, in DE-G 92 16 314.9 and includes a basic container with foldable side walls as well as one or more expansion elements which can be moved out of the basic container. An expansion element has two side walls and one front wall. With the expansion element moved out, two folded-open side walls of the basic container form the roof wall and the floor wall of an expansion element. A disadvantage of this construction are the large sealing lengths which are required for the sealing of the container along the roof wall and floor wall. This presents a problem particularly when ABC (atomic, biological, chemical) tightness is demanded.

Another expandable container is described in EP 0 682 156 B1 and has a basic container as well as one or more expansion elements for expanding the interior space. The expansion element can be moved out of the basic container. The expansion elements are box-shaped and, with the exception of the open side toward the basic container, are closed on all sides. For achieving an even floor within the entire container, a lifting device is also provided so that the expansion elements can be lowered with the result that, after the lowering step, the floor walls of the basic container and the expansion element are situated at the same level. In the construction with two expansion elements, the dimensions of the two expansion elements have to be selected such that one expansion element can be moved into the other expansion element.

DE 101 35 226 A1 describes an expandable container of the above-mentioned type which has a lifting device for achieving an even floor so that the expansion elements can be lowered and thereafter the floor walls of the basic container and of the expansion element are situated at the same level. The expansion elements are open toward the top. A side wall, which can be folded about a horizontal axis, is situated on the basic container and, when the expansion element has moved out, forms the roof wall of an expansion element. This construction achieves an improved standing height in an expansion element.

SUMMARY OF THE INVENTION

An object of the present invention is to provide an expandable container which, on one hand, has a sufficient standing height also in the expansion elements and, on the other hand, has a mechanically robust lifting device which is simple to operate.

This object has been achieved by providing that the lifting device is active between the folded-open side wall and an expansion element

BRIEF DESCRIPTION OF THE DRAWINGS

These and other objects, features and advantages of the present invention will become more readily apparent from the following detailed description of currently preferred configurations thereof when taken in conjunction with the accompanying drawings wherein.

DETAILED DESCRIPTION OF THE DRAWINGS

Figure 1A:
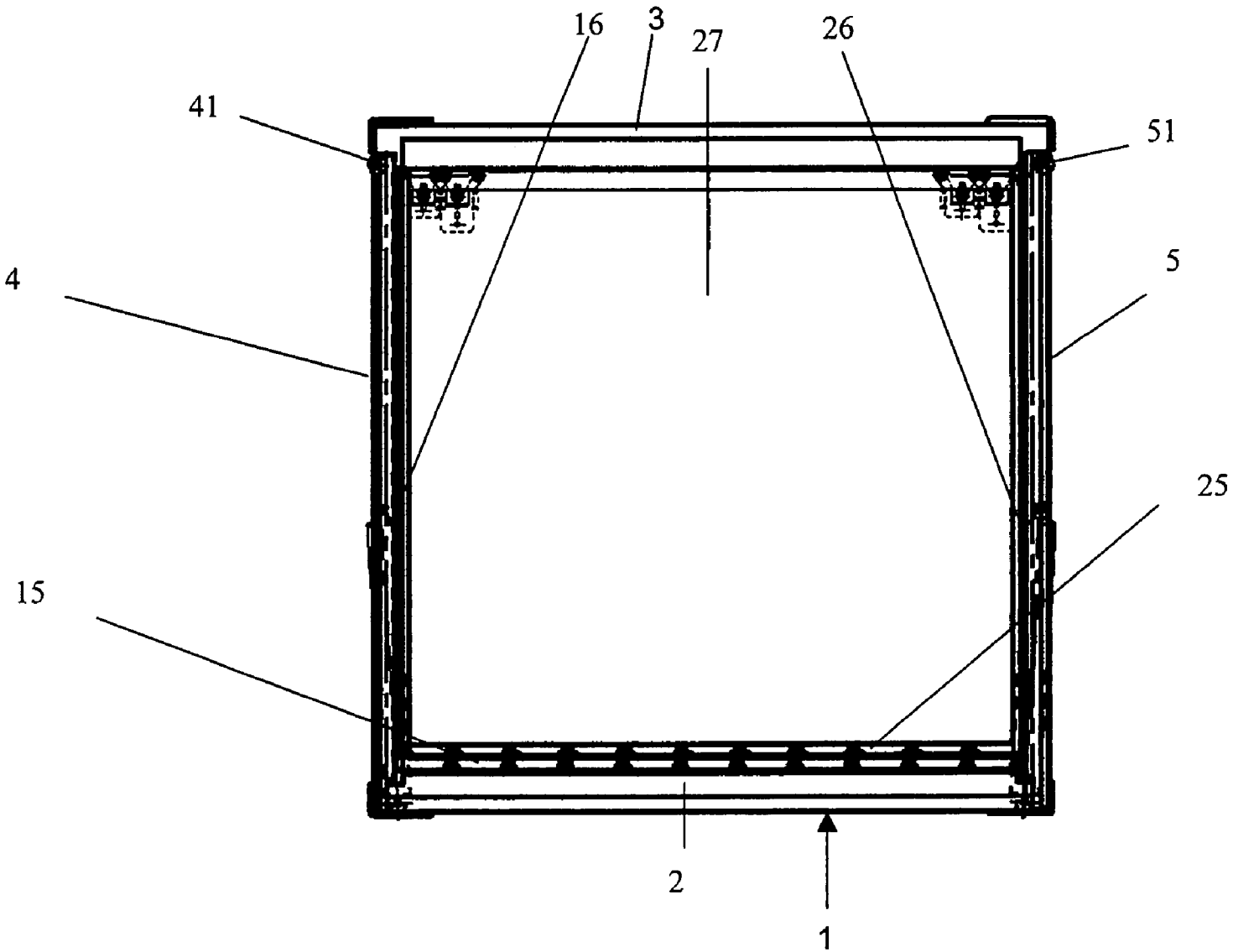
FIGS. 1*a*) to *d*) are vertical sectional views, respectively, of a four-step process for unfolding a container according to the invention.

FIGS. 1*a*) to *d*) show the individual steps during the construction of an expandable container according to the invention having two expansion elements 10, 20. FIG. 1*a*) shows the initial (or transport) condition. The box-shaped basic container or unit 1 contains the two expansion elements 10, 20 (FIG. 1*c*). In this embodiment, the expansion element 20 has moved into the expansion element 10 which is slightly larger with respect to the length and height. The floor wall 15, 25 and the front wall 16, 26, respectively, of the two expansion elements 10, 20 as well as a side wall 27 of the interior expansion element 20 are visible. The basic container 1 has a floor wall 2, a roof wall 3 as well as two foldable side walls 4, 5 which are each rotatably about a horizontal axis 41, 51 disposed on the upper edge of a container wall.

Figure 1B:
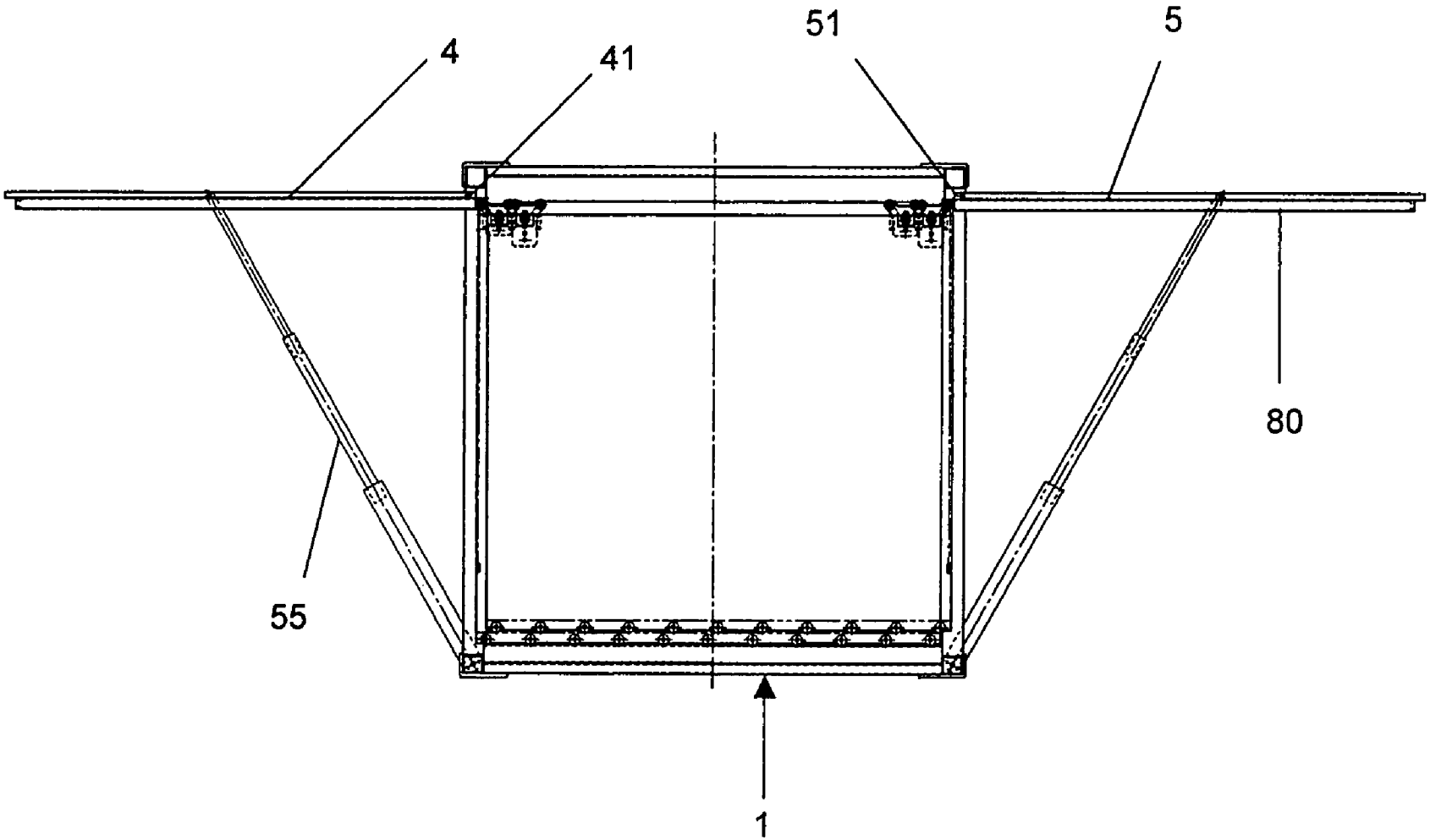
Figure 1C:
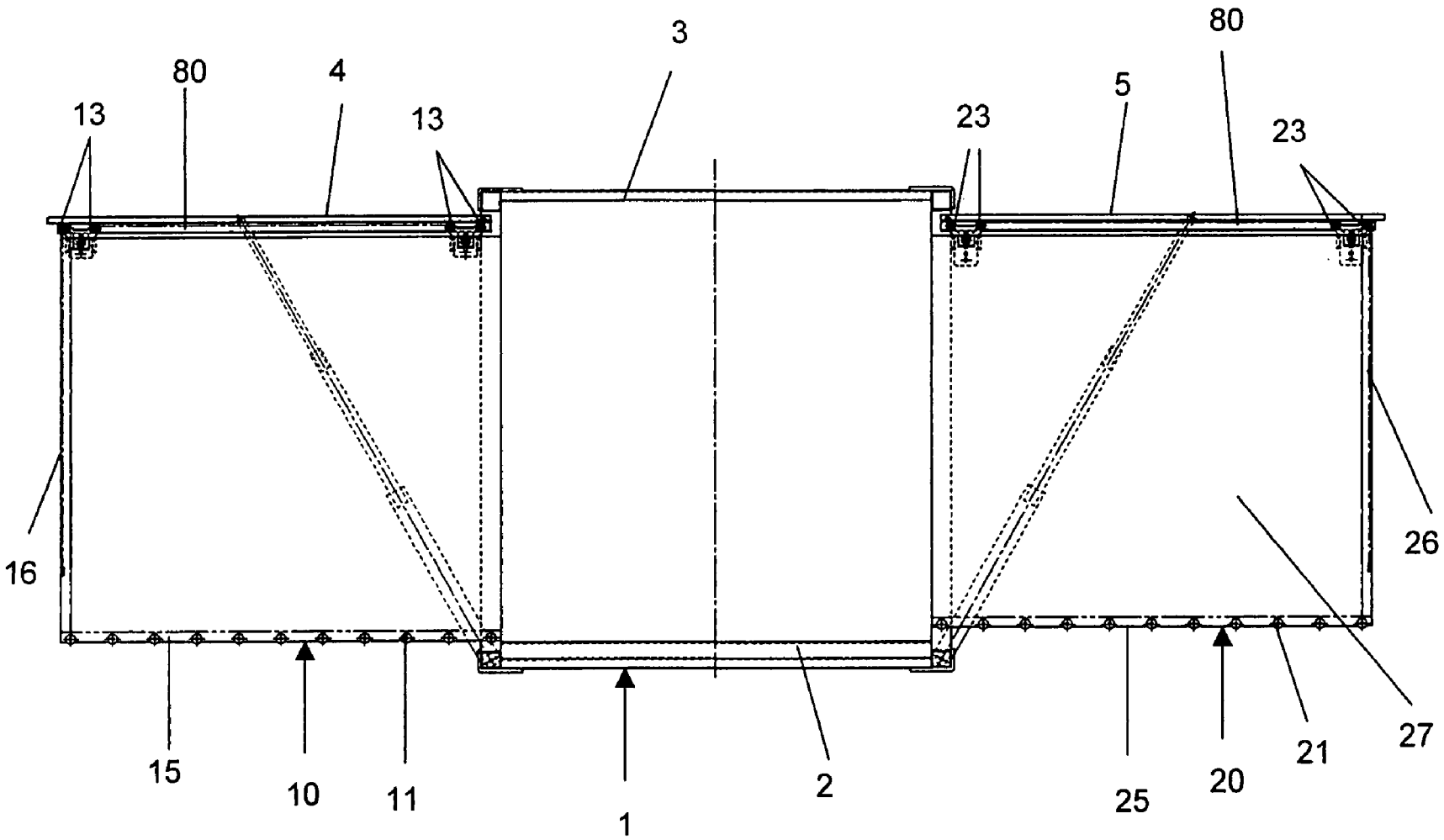

In FIG. 1*b*), the two foldable side walls 4, 5 are folded upward and are now situated essentially in a horizontal plane. The side surface of the basic container 1 and the folded-open side wall 4, 5 form a right angle. In this position, the folded-up side walls 4, 5 are supported on a linear actuator 55 or a like support whose length can be changed and which, with its other end, is arranged on the basic container 1. The support 55 may be constructed, for example, as a telescopable lifting cylinder (e.g., pneumatic, hydraulic, electromechanical).

In FIG. 1*c*), the two expansion elements 10, 20 have moved out completely. This takes place by way of rollers 13, 23 which engage in tracks 80 (see also FIG. 2) provided on the folded-up side walls 4, 5. Two tracks are advantageously provided for each expansion element. In addition, an expansion element 10, 20 has floor rollers 11, 21 in the floor area, which, during the moving-out, roll on the floor wall 15 of the larger expansion element 10 and on the floor wall 2 of the basic container 1, respectively. The folded-up side walls 4, 5 of the basic container 1 now form roof walls of the expansion elements 10, 20. A folded-up side wall 4 or 5 will therefore in the following also be called a roof wall depending on the context.

The moving-out of the two expansion elements 10, 20, in each case, takes place in the horizontal direction, i.e., without any change in the vertical direction. Thus, the floor levels of the expansion element 10, 20 and of the base container 1 differ in each case, the floor level of the basic container 1 being the lowest and the floor level of the small expansion element 20 being the highest. For example, the difference between the levels of the smaller expansion element and the basic container is approximately 100 mm, while the difference between the levels of the larger expansion element 10 and the basic container 1 is approximately 50 mm.

Figure 1D:
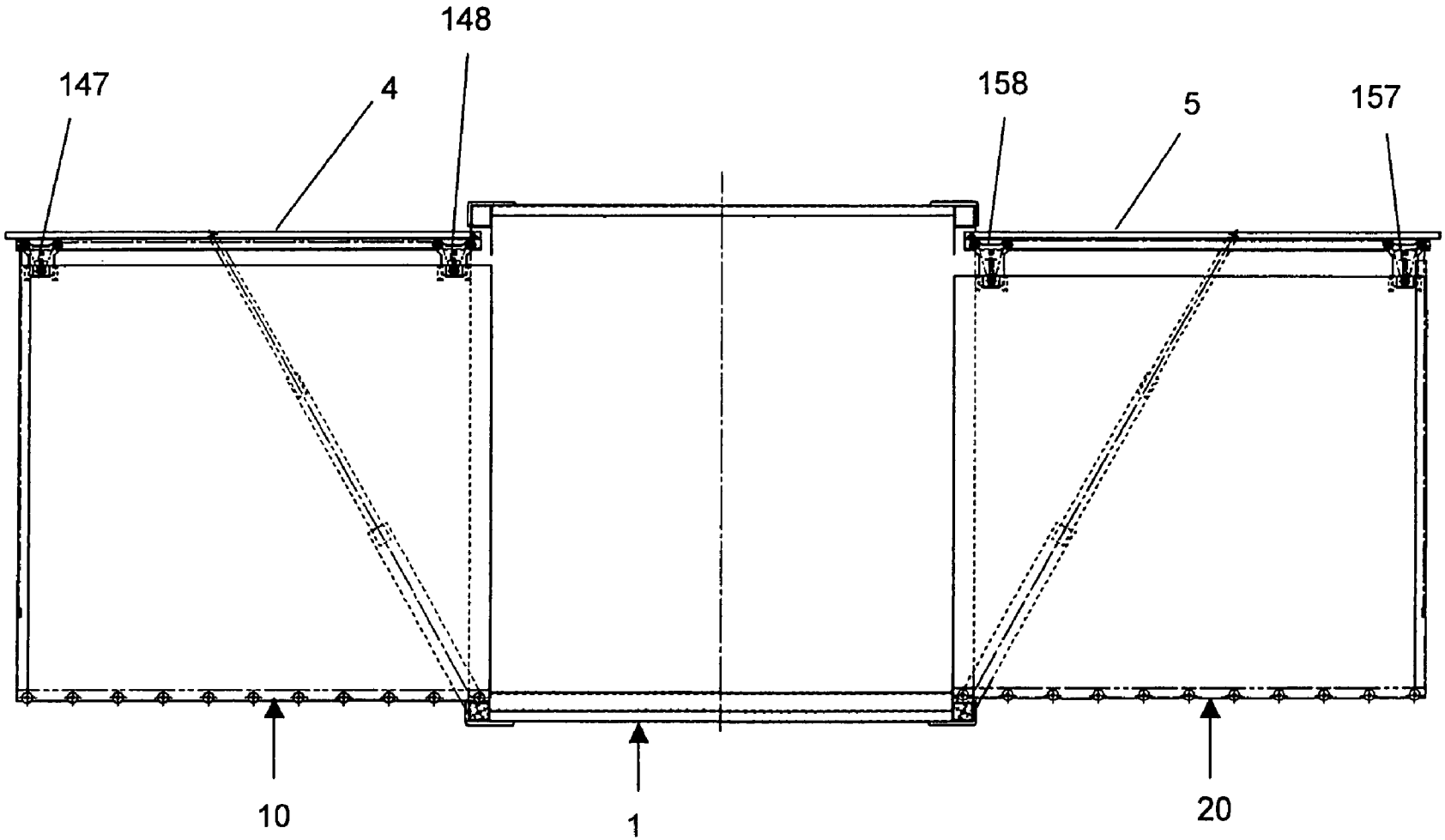
Figure 5:
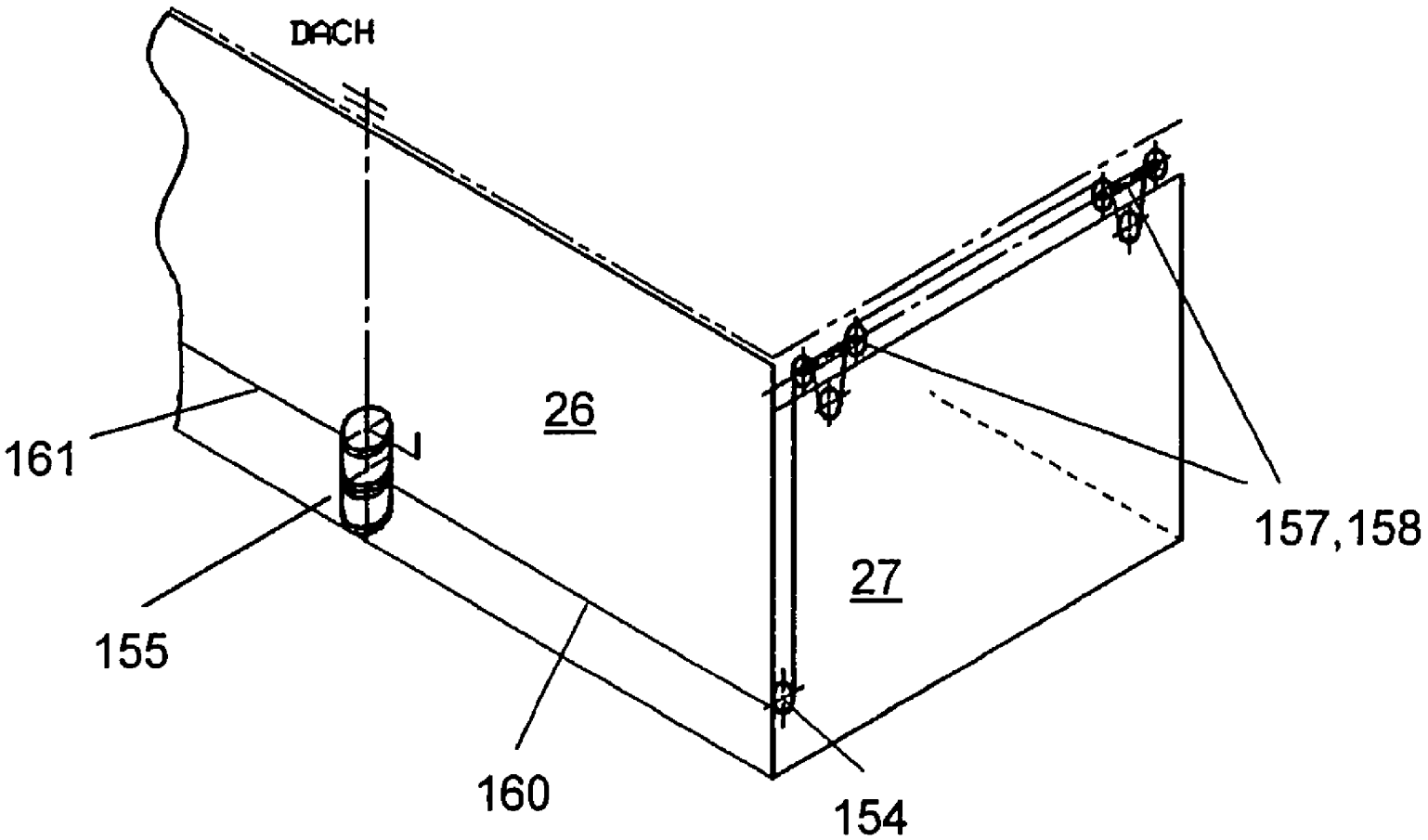
FIG. 5 is a lateral perspective view of an expansion element with the lifting device according to the present invention.

FIG. 1*d*) shows the completely unfolded container with lowered expansion elements 10, 20, so that now a uniform floor level is produced inside the entire expanded container. The lowering movement takes place in a parallel manner, i.e., in such a manner that the floor surface of an expansion element is oriented horizontally during the lowering operation and particularly when the end position is reached. The lowering of the expansion element 20 takes place on the two traveling carriages 157, 158 (likewise traveling carriages 147, 148 for expansion element 10), on which the above-mentioned rollers 13, 23 are arranged for the moving-out of the expansion elements 10, 20. The lowering is carried out by a lifting device which, in the embodiment illustrated here, is constructed as a cable winch as also seen in FIG. 5.

Figure 2:
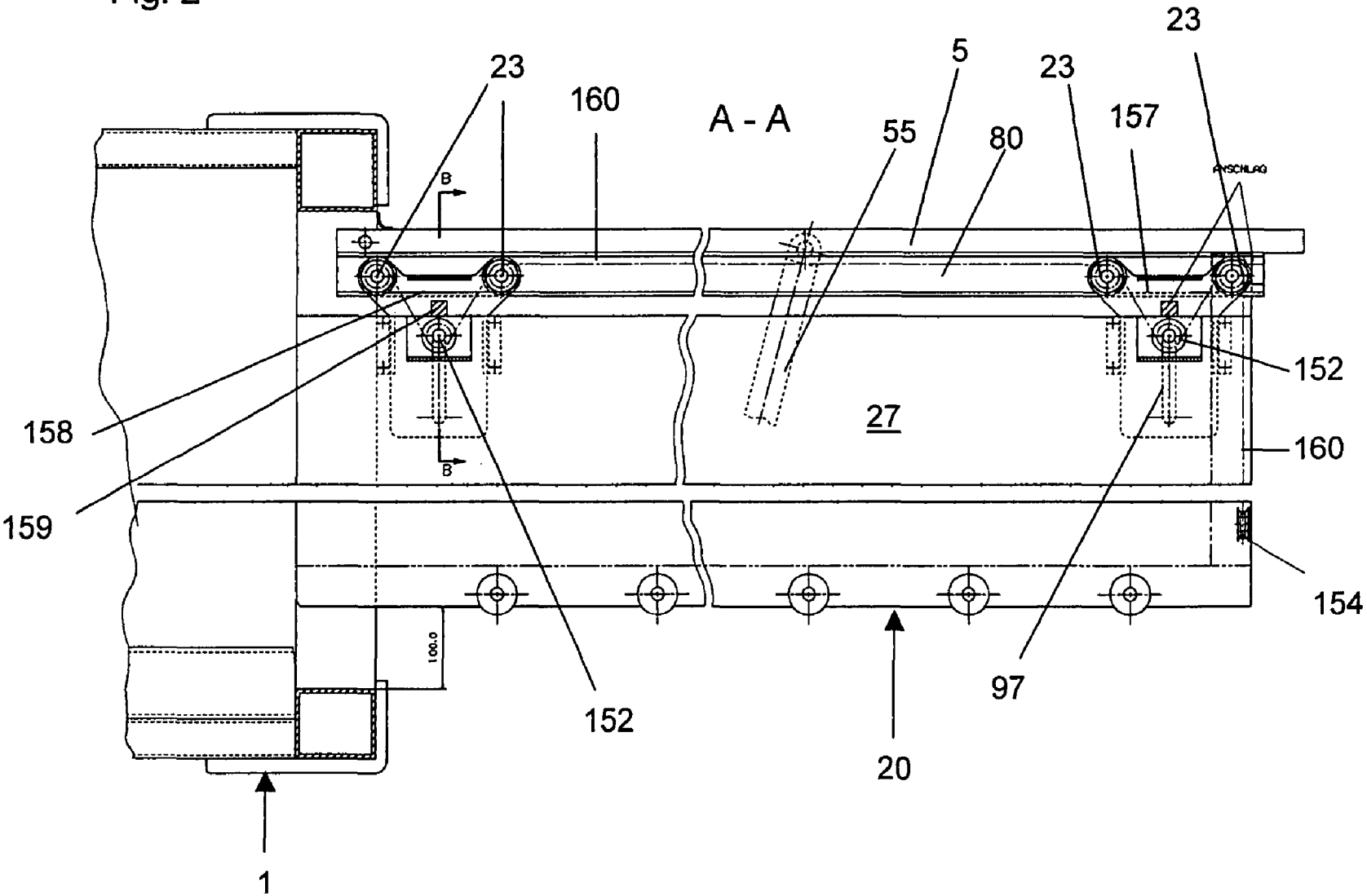
FIG. 2 is a vertical sectional view of a container according to the present invention with a moved-out expansion element.

For a more detailed explanation of the lowering mechanism, reference is made to FIG. 2 in which the expansion element 20 has been moved out completely from the basic container 1 but has not yet been lowered. The foldable side wall 5 of the basic container 1 had previously been folded from its vertical position of the transport condition upward into a horizontal position and is supported on the device 55 shown in dotted lines.

Figure 4:
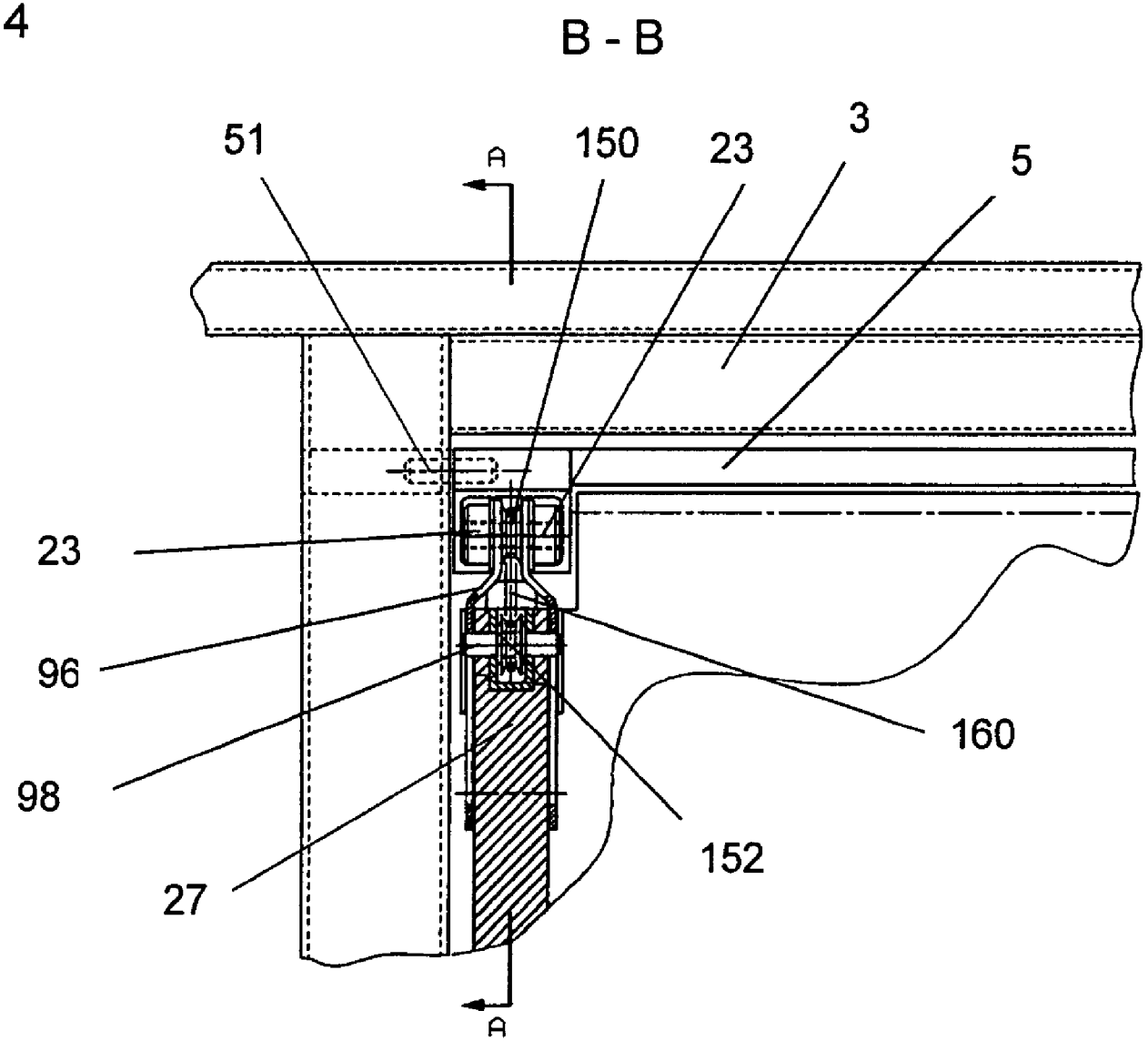
FIG. 4 is a sectional view along line B-B in FIG. 2 of a container according to the present invention.

A track 80 is arranged on the foldable side wall 5 for guiding two traveling carriages 157, 158 via the rollers 23. In addition to the above-mentioned traveling rollers 23 (in the illustrated embodiment, four traveling rollers per carriage), a traveling carriage 157 or 158 has several (in the illustrated embodiment, two) guide rollers 150 (FIG. 4) for guiding a cable 160 of a cable winch 155 (FIG. 5). As illustrated in FIG. 4, the two traveling rollers 23 as well as one guide roller 150 of a traveling carriage 157 or 158 are advantageously arranged on the same pin. The cable 160 is fastened to the innermost guide roller 150 of the traveling carriage 158 adjacent to the basic container 1. Additional guide rollers 152 for the cable 160 are arranged in the area of the upper edge of the expansion element 20, specifically in each case below the traveling carriages 157, 158.

From the described fastening point of the cable on the interior traveling carriage 158, the cable 160 is alternately guided by the guide rollers 150 (FIG. 4) on the expansion element 20 as well as by way of guide rollers 152 on the traveling carriages 157, 158. Thereby, in the area of the traveling carriages 157, 158, one guide roller 152 of the expansion element, respectively, comes to be situated between two guide rollers 150 of a traveling carriage. By way of another guide roller 154 in the area of a side wall 27 of the expansion element 20, the cable is finally guided to a cable winch 155 (FIG. 5) on the front wall 26 of the expansion element 20.

In the position illustrated in FIG. 2, the expansion element 20 is in its upper position. The top side of the side wall 27 of an expansion element 20 strikes against the stop 159 on a traveling carriage 157, 158. If the expansion element 20 now is to be lowered from the position illustrated in FIG. 2, the cable 160 has to be released by a certain length at the cable winch 155 (FIG. 5). As a result, the traveling rollers 152 and, with them, the expansion element 20 are lowered. To the extent that the point of gravity of an expansion element 20 is not significantly outside the center between the left side (side oriented toward the basic container) and the right side (exterior side) of the expansion element 20, the lowering for the left and the right side takes place in parallel. That is, no tilting of the expansion element 20 from the vertical line takes place.

Figure 3:
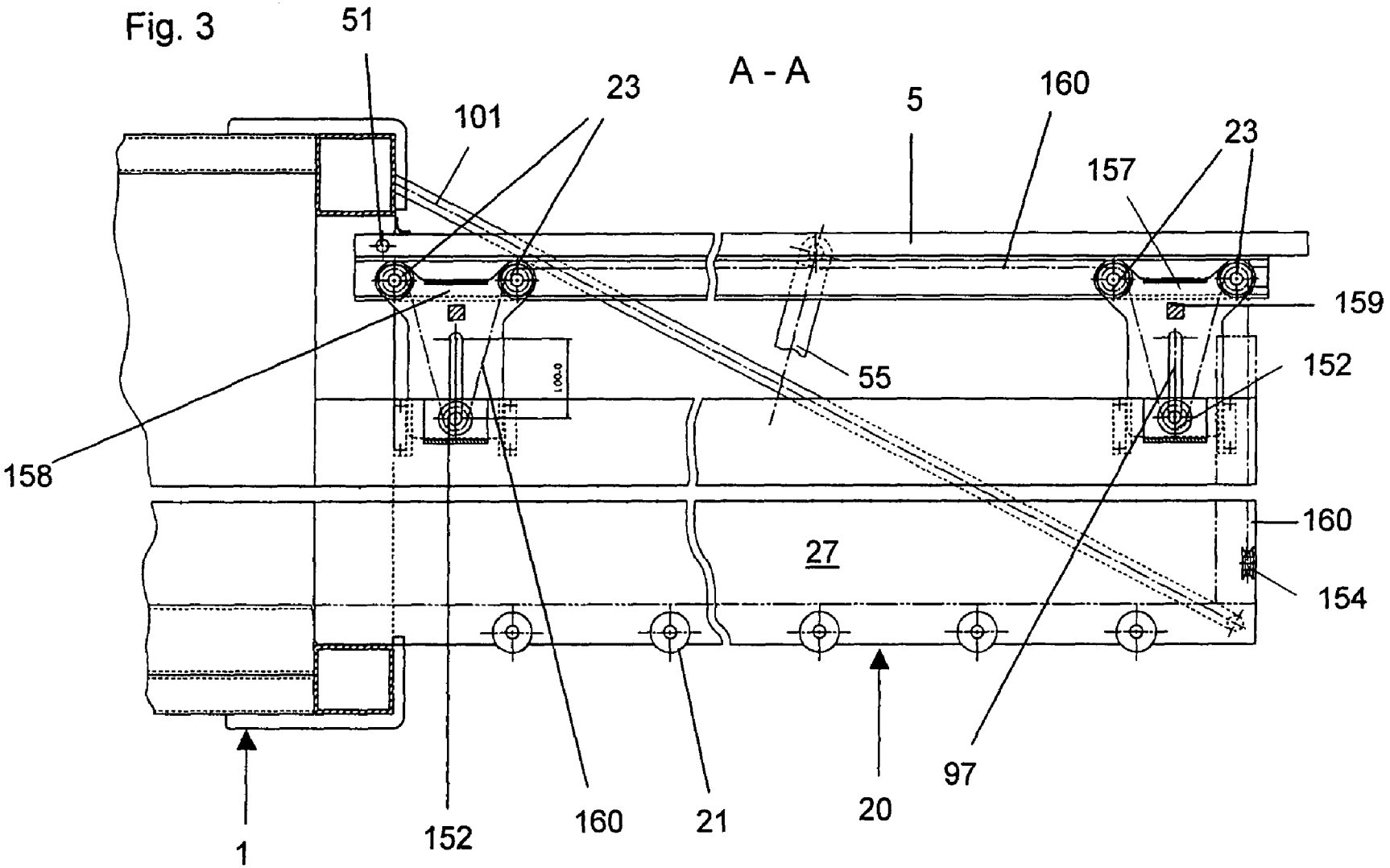
FIG. 3 is a vertical sectional view of a container according to the present invention with a moved-out and lowered expansion element.

In order to ensure a reliable vertical and parallel lowering, guiding devices in the form of metal plates (FIG. 4) can be mounted on the traveling carriages 157, 158. The metal plates 96 laterally reach around the upper area of a side wall 27 and have vertically extending gaps 97 or rails into which pins 98, pivots or bolts, engage and are connected with a respective expansion element 10, 20. In addition, diagonal tie bars 101 (shown in phantom lines in FIG. 3) can be mounted for supporting the expansion elements 10, 20 in the moved-out condition.

The described lowering movement is completely reversible. When the expansion element 20 is lifted, the cable winch 155 is operated in the reverse direction, so that the cable 160 is brought in. The expansion element 20 is lifted until the stops 159 on the traveling carriages 157, 158 strike against the top side of a side wall 27. The expansion element 20 can now be pushed into the basic container 1.

FIG. 5 is a more detailed view of the cable guidance of the cable winch. Previously, the lifting mechanism was described with respect to a single track by way of which with a cable 160, exactly one side of the expansion element 20 was lowered. Advantageously, the cable for the lowering of the other side of the expansion element is coupled with the same cable winch 155, so that finally only one lifting device has to be operated as illustrated in FIG. 5. The two cables for the left and the right side have the reference numbers 160 and 161. They are coupled with the central cable winch 155 on the front wall 26 of the expansion element 20.

Figure 6:
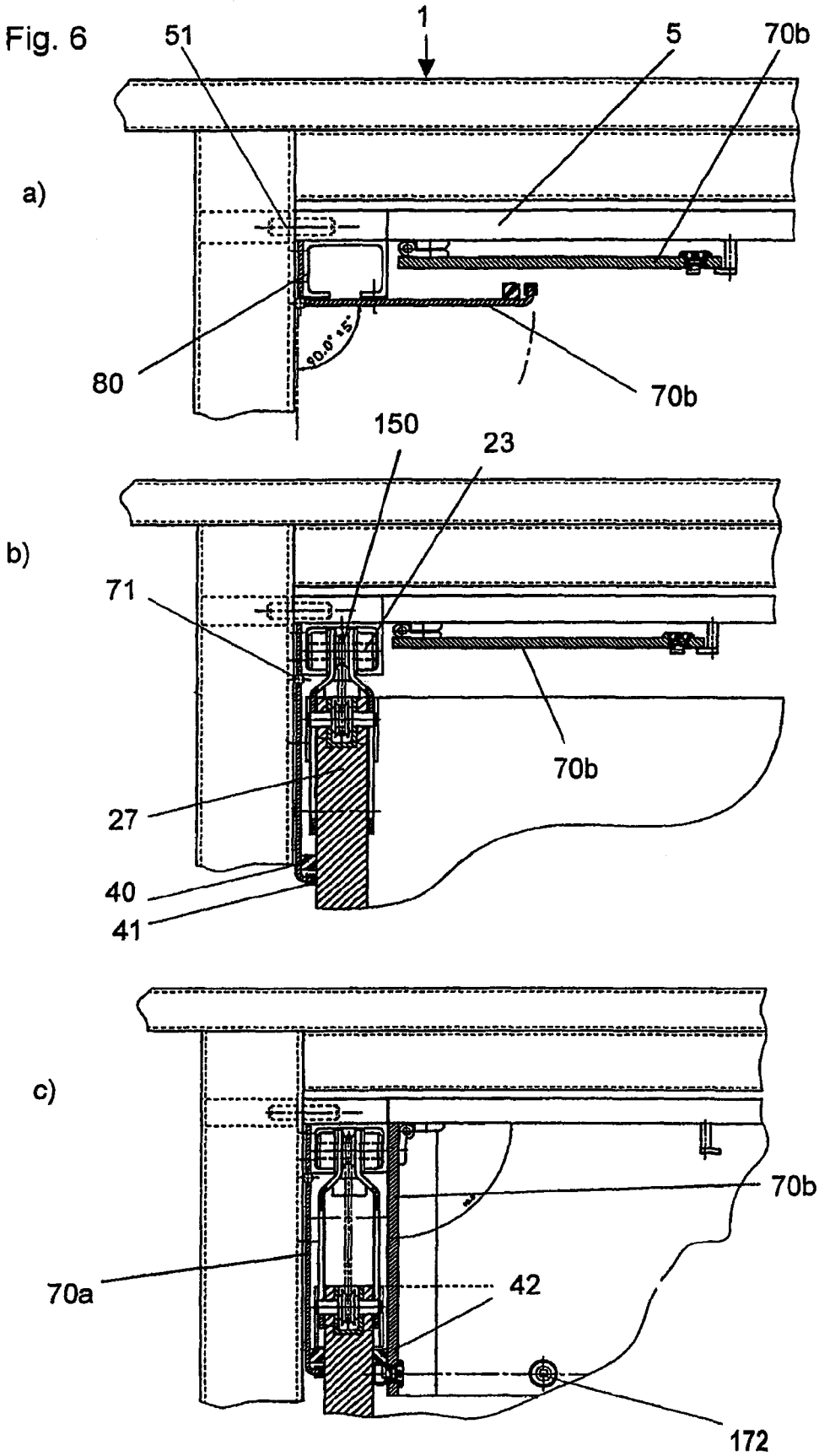
FIG. 6 is a vertical sectional view (corresponding to FIG. 4) of a container according to the present invention showing three different conditions a)-c) with additional surface elements on the side walls of an expansion element.

After the conclusion of the lowering operation, surrounding gaps occur between an expansion element and the pertaining roof wall. In order to close these, additional surface elements can advantageously be provided. For this purpose, FIG. 6 shows a first embodiment for covering the gap between the side wall 27 of an expansion element 20 and the roof wall 5. In this embodiment, the additional surface element has a two-shell construction (outer shell 70*a*, inner shell 70*b*), the two shells being arranged on the roof wall 5 in a foldable manner. The hinge 71 for the outer shell 70*a* is not arranged directly on the roof wall 5 but is offset downward by a cross-sectional width of the track 80 (the latter is used for guiding the expansion element 20 via the rollers 23 when the expansion element is moved out of the basic container, as described above), so that a folding-away by approximately 90 degrees is permitted without striking against the track 80.

FIG. 6*a*) shows the container when the side wall 5 is folded up, while the expansion element is still in the basic container 1. The two shells 70*a*, 70*b* of the additional surface element are still situated parallel to the roof wall 5. Before the moving-out of the expansion element, the outer shell 70*a* is folded downward.

FIG. 6*b*) shows the situation with the moved-out but not yet lowered expansion element. On the outer shell, sliding seals 40, 41 are provided which slide over the side wall 27 during the moving-out and lowering of the expansion element. The inner shell 70*b* is still in its initial position. After the expansion element has been lowered, the inner shell 70*b* is folded down (FIG. 6*c*). It has a contact seal 42 for sealing the container.

Figure 7:
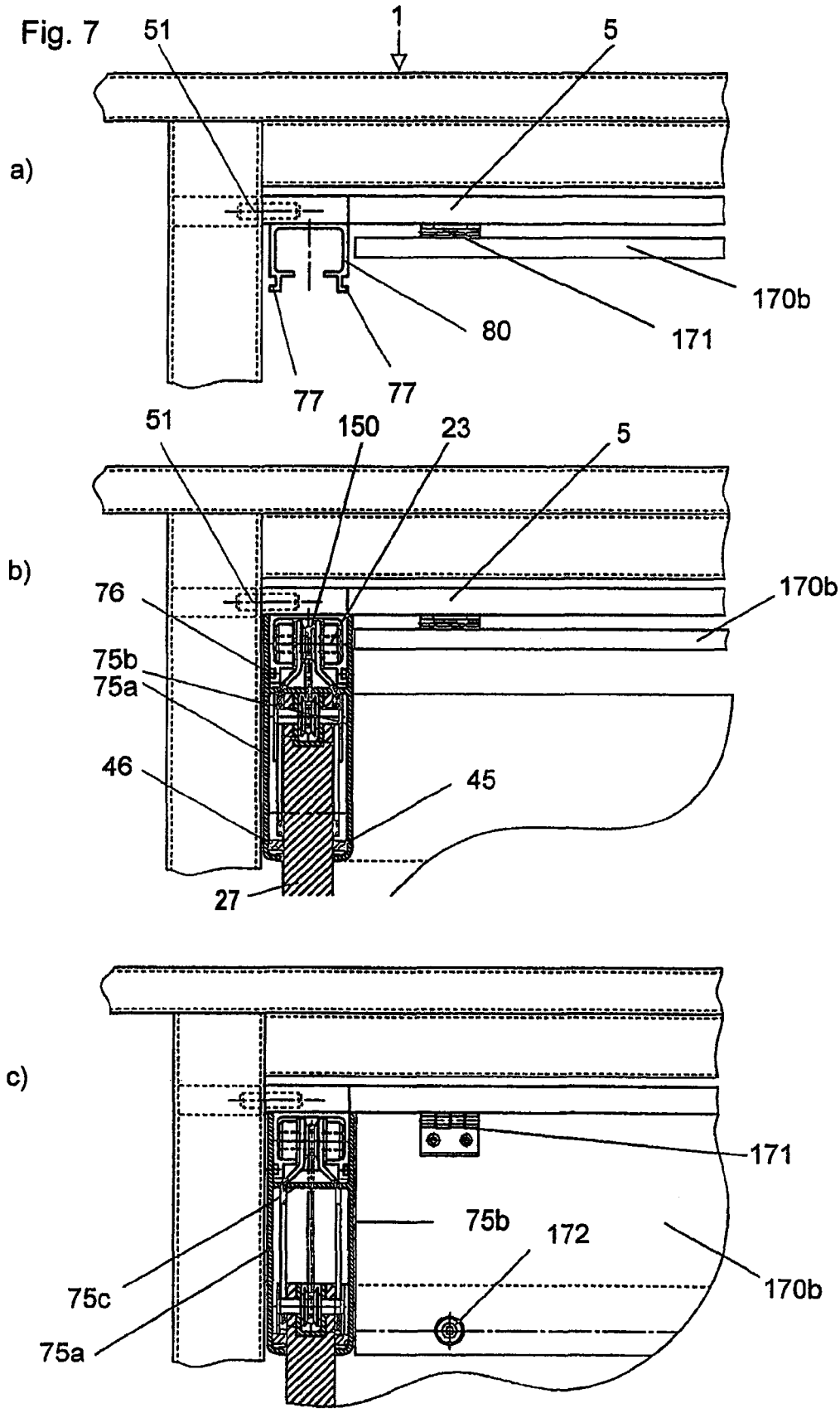
FIG. 7 is a vertical sectional view (corresponding to FIG. 4) of a container according to the present invention showing three different conditions with another construction of the additional surface elements on the side walls of an expansion element.

FIG. 7 shows another embodiment of an additional surface element between the side wall 27 and the roof wall 5. In this embodiment, the additional surface element is placed on the side wall 27 of an expansion element 20 and can be moved in a vertical manner with respect to the side wall 27. The surface element also has a two-shell construction (inner shell 75*b*, outer shell 75*a*).

In FIG. 7*a*), the expansion element is still in the basic container 1. The track 80, via which the expansion element 20 is guided out of the basic container 1 when it is moved out, in comparison to the embodiment according to FIG. 4, has additional paths 77 for the guiding of an inner and an outer shell of the additional surface element.

FIG. 7*b*) shows the situation with the moved-out expansion element 20, the latter still being in its highest position. The two-shell additional surface element is now visible and is placed on the side wall 27. The inner and outer shells 75*a*, 75*b* are connected by a web 75*c*. Each shell 75*a*, 75*b* has rollers 76 which engage in the paths 77 when the expansion element 20 is moved out. Sliding seals 45, 46 are present on each shell 75*a*, 75*b*.

FIG. 7*c*) shows the container with the lowered additional box element (side wall 27). The additional surface element, which is guided in the horizontal paths 77, remains in its original position, while the upper edge of the side wall 27 moves downward inside the two shells 75*a*, 75*b*.

Figure 8:
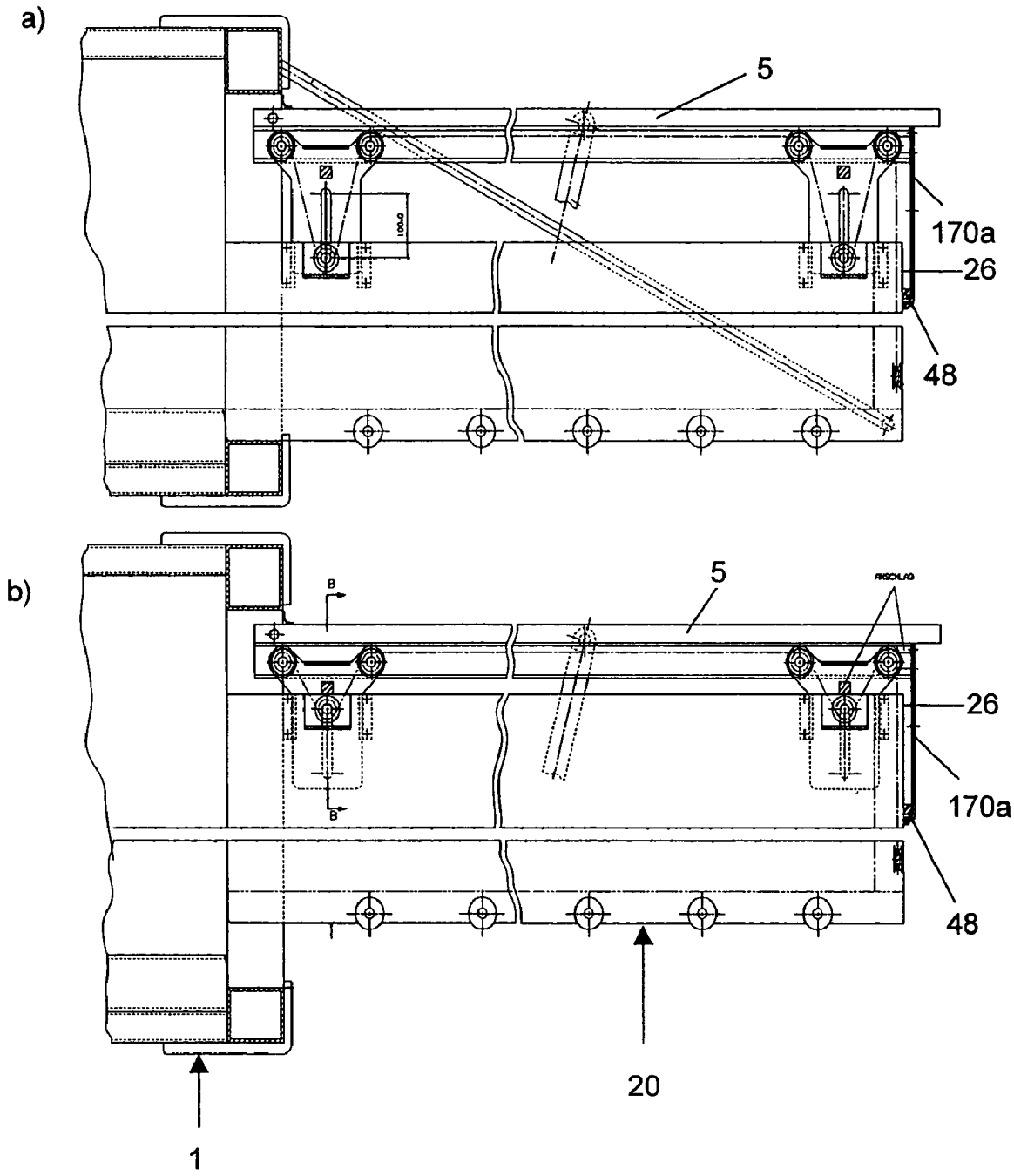
FIG. 8 is a vertical sectional view of a container according to the invention (corresponding to FIG. 2 or 3) showing two different conditions with additional surface elements on the front wall of an expansion element.

FIG. 7 also shows another additional surface element (inner shell 170*b*) which is foldably arranged on the roof wall 5 via hinge 171. This additional element 170*a* is used for closing the gap between the front side 26 (FIG. 8) of the expansion element 20 and the roof wall 5. The pertaining outer shell 170*a* is illustrated in FIG. 8. In FIG. 7*c*, the inner shell 170*b* is folded down and is locked in the vertical position by a turning lock 172.

FIG. 8 shows the outer shell 170*a* of the additional surface element for the closing of the gap between the front wall 26 of an expansion element 20 and the roof wall 5. The additional surface element 170*a* is rigidly arranged on the roof wall 5. When the roof wall 5 is folded down into its vertical starting position (i.e., transport configuration of the container), a space for receiving the additional surface element 170*a*, which space is open to one side, has to be provided at the lower edge of the basic container 1. The additional surface element 170*a* has a sliding seal 48 at its lower edge for sealing the gap between the additional surface element 170*a* and the front wall 26 of the expansion element 20.

In FIG. 8*b*), the expansion element 20 has moved out of the basic container 1 but has not yet been lowered. The expansion element 20 contacts the seal 48. During the lowering of the expansion element 20, the seal 48 slides on the front wall 26. FIG. 8*a*) shows the situation with a completely lowered expansion element 20.

The embodiments illustrated in the drawings each show constructions with exactly two expansion elements. Of course, also constructions with exactly one or more than two expansion elements are contemplated and within the scope of the present invention. The moving-out operation as well as the lowering operation take place analogously to the illustrated sequences for the individual expansion elements 10, 20.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A container usable as a working space with a variable volume, comprising:

a unit comprised of a floor wall, a roof wall and at least one side wall that is foldable about a horizontal axis;

at least one expansion element arranged to be movable out of the unit and having a floor, a side open to the unit and a front wall situated opposite the open side and in a permanently fixed position relative to the floor and open toward a top thereof, and, in a moved-out condition of the at least one expansion element, a roof wall thereof being formed by an associated side wall of the unit upon being folded open;

a lifting device including a cable winch attached to the at least one expansion element for lowering the at least one expansion element such that, after moving of the expansion element out of the unit, an upper surface of the floor wall of the moved-out expansion element and an upper surface of the floor wall of the unit are situated at the same level, and for lifting the at least one expansion element such that, after lowering, the expansion element is movable back into the unit; wherein the lifting device is configured to be active between the associated side wall after being folded upon and an associated one of the at least one expansion element, wherein tracks are provided on the at least one side wall to guide the at least one expansion element, and a first group of rollers being operatively attached on traveling carriages for moving the at least one expansion element out of or into the unit along the tracks, and a second group of rollers being operatively attached on the traveling carriages with a cable of the cable winch for lifting and lowering the at least one expansion element, wherein the traveling carriages are slidably positioned in the tracks via the first group of rollers, and guided in the tracks via the first group of rollers.

2. The container according to claim 1, wherein the unit has two foldable side walls and two expansion elements that are movable out of the unit in opposite directions from each other, the dimensions of the expansion elements being selected such that one expansion element is movable into the other expansion element, and a lifting device is attached to each expansion element to be effective between a side wall and an associated expansion element.

3. The container according to claim 1, wherein guiding devices for guiding the at least one expansion element during the lifting and lowering movement are arranged on the traveling carriages.

4. The container according to claim 2, wherein the cable winch attached to the at least one expansion element comprises two cables secured with one of two expansion elements so as to be windable off or on by a common drive.

5. The container according to claim 1, wherein surface elements are provided to close gaps between the at least one expansion element and the associated side wall resulting from the lowering of the at least one expansion element, whereby an interior space is created which is completely closed off toward the outside of the unit.

6. The container according to claim 5, wherein the surface elements have a multi-shell construction.

7. The container according to claim 6, wherein a shell of the multi-shell surface element is provided for a gap between the front wall and the side wall of the unit and is rigidly fastened to the side wall thereof.

8. The container according to claim 5, wherein the surface elements are foldable away from the associated side wall of unit.

9. The container according to claim 8, wherein the surface elements have a multi-shell construction.

10. The container according to claim 5, wherein the surface elements are provided at a side wall of the at least one expansion element and are vertically movable with respect to the at least one side wall of the unit.

11. The container according to claim 10, wherein the surface elements have a multi-shell construction.

12. The container according to claim 10, wherein when the at least one expansion element is moved out of the unit, the surface elements are guided in a path arranged at the tracks.

13. The container according to claim 5, wherein seals are provided for sealing between the surface elements and the expansion element.

14. The container according to claim 13, wherein the surface elements have a multi-shell construction.

15. The container according to claim 14, wherein a shell of the multi-shell surface element is provided for a gap between the front wall and the at least one side wall of the unit and is rigidly fastened to the at least one side wall.

16. The Container according to claim 13, wherein the surface elements are foldable away from the at least one side wall of the unit.

17. The container according to claim 13, wherein the seals are at least one of sliding and contact seals.

* * * * *